US005615951A

United States Patent [19]

Gabriele

[11] Patent Number: 5,615,951

[45] Date of Patent: Apr. 1, 1997

[54] FOOD PROCESS AGITATORS

[75] Inventor: Valentino Gabriele, Baltimore, Md.

[73] Assignee: J. C. Pardo & Sons, Baltimore, Md.

[21] Appl. No.: 570,716

[22] Filed: Dec. 11, 1995

[51] Int. Cl.[6] ..... B01F 7/02

[52] U.S. Cl. ..... 366/311; 99/348

[58] Field of Search ..... 99/348; 366/279, 366/309, 310, 311, 312, 313

[56] References Cited

U.S. PATENT DOCUMENTS

| | | | |
|---|---|---|---|
| 4,125,065 | 11/1978 | Lee | 99/348 |
| 4,151,792 | 5/1979 | Nearhood | 99/348 |
| 4,571,091 | 2/1986 | Pardo | 366/312 |
| 4,790,667 | 12/1988 | Pardo | 366/312 |
| 4,818,116 | 4/1989 | Pardo | 366/311 |
| 5,009,510 | 4/1991 | Gabriele | 366/311 |

*Primary Examiner*—Robert W. Jenkins
*Attorney, Agent, or Firm*—Kenneth E. Darnell

[57] ABSTRACT

Agitators having processing grates intended to mix and process food or other materials in a kettle either with or without heating of the materials, the mixing structures of the invention being particularly useful in the processing of food such as mashed potatoes to produce a product which has naturally-occurring "lumps" indicative of the use of real potatoes in the production of the product. The processing grates of the invention are preferably employed with horizontally disposed rotary shaft agitators operable within a kettle having a substantially hemispherical bottom portion, inner walls of the kettle being preferably scraped by scraping elements of the agitators to prevent burn-on of food materials during a mixing and/or cooking process. The processing grates of the invention can also function mounted to diagonally disposed rotary shaft agitators, the processing grates acting to reduce a food material such as potatoes to a homemade "lumpy" consistency. The potatoes are cooked either prior to or during subjection to the mixing action of the present agitators to produce a desirable product consistency such as is associated with a homemade mashed potato or similar product.

47 Claims, 5 Drawing Sheets

FOOD PROCESS AGITATORS

BACKGROUND OF THE INVENTION

1. Field of the Invention

The invention relates to agitator structures used in the mixing of foods and particularly to the mixing of foods such as mashed potatoes to yield a homemade "lumpy" consistency.

2. Description of the Prior Art

Foods, cosmetics, pharmaceuticals and many other materials have long been mixed in kettles or in containers of various shapes and sizes through the use of agitator structures. Mixing of such materials through the use of agitator structures has also been commonly accomplished in the art before, during and/or after heat treatment such as cooking in the case of food materials and the like. While agitator structures can provide a desired mixing capability without the scraping of a kettle wall, for example, scraping elements are often provided so that interior surfaces of a kettle or container can be continually scraped during the mixing process. Agitators capable of mixing food materials while the materials are being heated and/or cooked include the agitator described by Groen, Jr. in U.S. Pat. No. 3,752,057, the Groen agitator having a diagonally mounted shaft which extends into the open end of a mixing kettle with scraping elements being mounted to that end of the diagonal shaft which extends into the mixing kettle. The scraping elements scrape interior surfaces of the kettle and are maintained in contact therewith by virtue of an accurate placement of the diagonally-disposed agitator shaft relative to the kettle. Care must be taken in the placement of the Groen shaft relative to a kettle when using the Groen, Jr. agitator. The Groen, Jr. agitator also finds itsmost convenient use when operated with a mixing kettle which is open to the atmosphere. Agitators operable about a horizontal axis within a mixing kettle or the like are described by Giusti, in U.S. Pat. No. 4,199,266, Giusti providing scraping elements which are mounted in fixed positions on the agitator. Since the scraping elements of Giusti are not capable of pivotal movement by virtue of structure mounting the scraping elements to the agitator, the scraping elements of Giusti do not continuously "track" the interior surfaces of a kettle especially when these interior surfaces are "out of round" as is often the case with cooking kettles. Pardo et al, in U.S. Pat. Nos. 4,571,091; 4,790,667 and 4,818,116 as well as Gabriele in U.S. Pat. No. 5,009,510, describe agitator structures having scraping elements which continuously track the interior surfaces of a kettle within which materials are being mixed, the scraping elements being resiliently biased into contact with interior surfaces of the kettle even when such interior surfaces are "out of round". The agitators of Pardo et al have been shown to be particularly useful in the mixing of food materials which are being heated and/or cooked. The continual and substantially complete mixing and scraping action of the Pardo et al agitators facilitate mixing of food materials without damage thereto and also act to prevent "burn-on" of food materials to walls of a kettle during mixing and/or cooking. The Pardo et al agitators exhibit extremely efficient mixing and scraping actions due in part to the ability of the scraping elements to maintain contact with interior walls of a kettle even when the kettles are not manufactured with perfectly spherical interior surfaces. The scraping elements of the Pardo et al agitators are contoured with scraping edges which conform to localized portions of interior surfaces of a kettle, the scraping elements being spring-biased for pivotal movement to assure contact between the scraping edges and the surfaces of the kettle. The particular mounting arrangements of the scraping elements in the Pardo et al agitators and in the Gabriele agitator allow efficient mixing and/or scraping while allowing the scraping elements to be readily removed from the agitators for cleaning of the scraping elements and of the agitators. The agitators of the present invention can take the form of the diagonal shaft agitator of Groen, Jr. as described above or preferably the horizontal shaft agitators of Pardo et al and of Gabriele as well as other diagonal shaft and horizontal shaft agitators as exist in the art, the Pardo et al agitators and the Gabriele agitator being preferred in combination with the structures of the present invention.

The prior art also includes a consideration of the desirability of producing certain food products such as mashed potatoes with a "lumpy" consistency such as occurs in a "homemade" mashed potato product. The advent of instant food materials such as instant mashed potatoes and the like has resulted in mashed potato products, particularly in commercial food situations, which are perceived as being inferior to mashed potatoes or similar products formed directly from real, cooked whole potatoes. Such instant potato products usually have the characteristic of being extraordinarily "smooth", that is, without lumps such as are characteristic of homemade mashed potatoes formed directly from real, cooked whole potatoes. The present invention provides agitator structures useful in the processing of a mashed potato product which readily, easily and efficiently produces a "lumpy" consistency indicative of the use of real potatoes in the preparation of the mashed potato product. The resulting "lumpy" mashed potatoes, especially in a commercial or institutional food situation, causes the mashed potato product to have a greater perception of value due to the realization by the consumer that the mashed potato product is formed of real potatoes and is not an instant potato product.

SUMMARY OF THE INVENTION

Agitators of the present invention are particularly intended for use in the food processing arts and can be used as mixing agitators or as mixing/scraping agitators. Especially when intended to scrape a surface such as an internal heated wall of a cooking kettle, the present agitators include scraping elements and also provide processing grates intended to rapidly reduce food materials such as cooked potatoes or potatoes cooking within a kettle to a consistency such as is associated with a homemade mashed potato or similar product. Kettles used in cooking or heating of food materials and which are useful with the agitators of the invention typically have a constant radius in the hemispherical portion of the kettle which is intended to contain the food materials being heated or cooked. These kettles are typically provided with a steam jacket for introducing heat into the materials which are to be cooked or heated. As one alternative, kettles useful with the present agitators are gas-fired. The present agitators are primarily useful with such kettles when used for heating and/or cooking, the scraping capability of the present agitators being particularly important in heating/cooking process situations. The scraping elements of the present agitators also provide lifting, folding and blending of food materials in both heating/cooking process situations as well as in situations requiring only simple mixing and blending. The processing grates of the present agitators provide additional mixing capability but are particularly useful in the reduction of food materials to a desired product consistency including the production of "lumps" of a desired size, number and distribution within a product such as mashed potatoes and the like.

While the present mixing agitators are particularly useful when mounted within a kettle with the longitudinal axis of a rotating shaft of one of said agitators being disposed horizontally, it is to be understood that the mixing agitators of the invention can be configured to operate with a rotating shaft thereof disposed in a diagonal disposition as is known in the art. When horizontally oriented, the mixing agitators of the invention can be compactly utilized with standard mixing kettles and can be used with mixing kettles whereby the normally open end of such a kettle is closed due to a particular operating situation. A particularly useful mixing agitator structure is shown and described in U.S. Pat. No. 4,790,667, the disclosure of which patent is incorporated hereinto by reference, and the processing grates of the present invention are preferably mounted to the shaft of the agitator described in U.S. Pat. No. 4,790,667, thereby to produce an extremely effective mixing agitator having the capability of producing a homemade "lumpy" mashed potato or similar product of a desired consistency. U.S. Pat. No. 4,790,667 describes particular arrangements of mixing elements, scraping elements and the like capable of producing desirable mixing and scraping functions. In the structures of the mixing agitators according to the present invention, processing grates of particular structure provide the primary means for obtaining a desired size, quantity and distribution of "lumps" or the like in a "mashed" product formed of real potatoes or the like.

The processing grates of the invention are formed of substantially U-shaped frame elements wherein distal ends of the legs thereof are mounted directly to a shaft of the agitator. Reducing bars also mount directly to the shaft of the agitator at one end and to the bight portion of the frame elements at the other ends of the bars. The reducing bars can take the form of cylindrical bars, bars of a rectangular solid cross-sectional shape and flat, twisted bars inter alia, round bars typically providing the best size and shape for a "lump" formed in a mashed potato product or the like produced through use of the present apparatus.

It is therefore an object of the invention to provide a mixing agitator used with a kettle and being capable of producing a food material such as mashed potatoes having a homemade, "lumpy" consistency.

It is another object of the invention to provide processing grates useful with mixing agitators of varying description and being particularly useful in the food processing industry for production of a mashed potato or similar product of a desired consistency and which includes "lumps" indicative of formation of the food product from real potatoes.

It is yet another object of the invention to provide a mixing agitator which is particularly useful in the food processing industry and which includes a horizontally disposed rotary shaft having arcuate mixing elements at the ends of the shaft with scraper elements being mounted to the arcuate mixing elements and being capable of continuous adjustment to accommodate wear and the like to maintain scraping of surfaces in contact with food contacting walls of a kettle during cooking or heating of food materials such as potatoes and the like for production of a finished mashed potato or similar product having a desired product consistency including lumps such as is indicative of a homemade mashed potato product.

It is a further object of the present invention to provide mixing agitators either with or without scraping assemblies and having processing grates mounted to rotary shafts of said agitators, the processing grates having bar-like elements of certain cross-sectional shapes which facilitate the production of "lumps" of a desired shape, size, number and distribution within a food product such as mashed potatoes or the like.

Further objects and advantages of the invention will become more readily apparent in light of the following detailed description of the preferred embodiments.

DESCRIPTION OF THE PREFERRED EMBODIMENTS

The disclosures of U.S. Pat. Nos. 4,571,091, issued Feb. 18, 1986; 4,790,667, issued Dec. 13, 1988; 4,818,116, issued Apr. 4, 1989; and 5,009,510, issued Apr. 23, 1991, are incorporated hereinto by reference.

Figure 1:
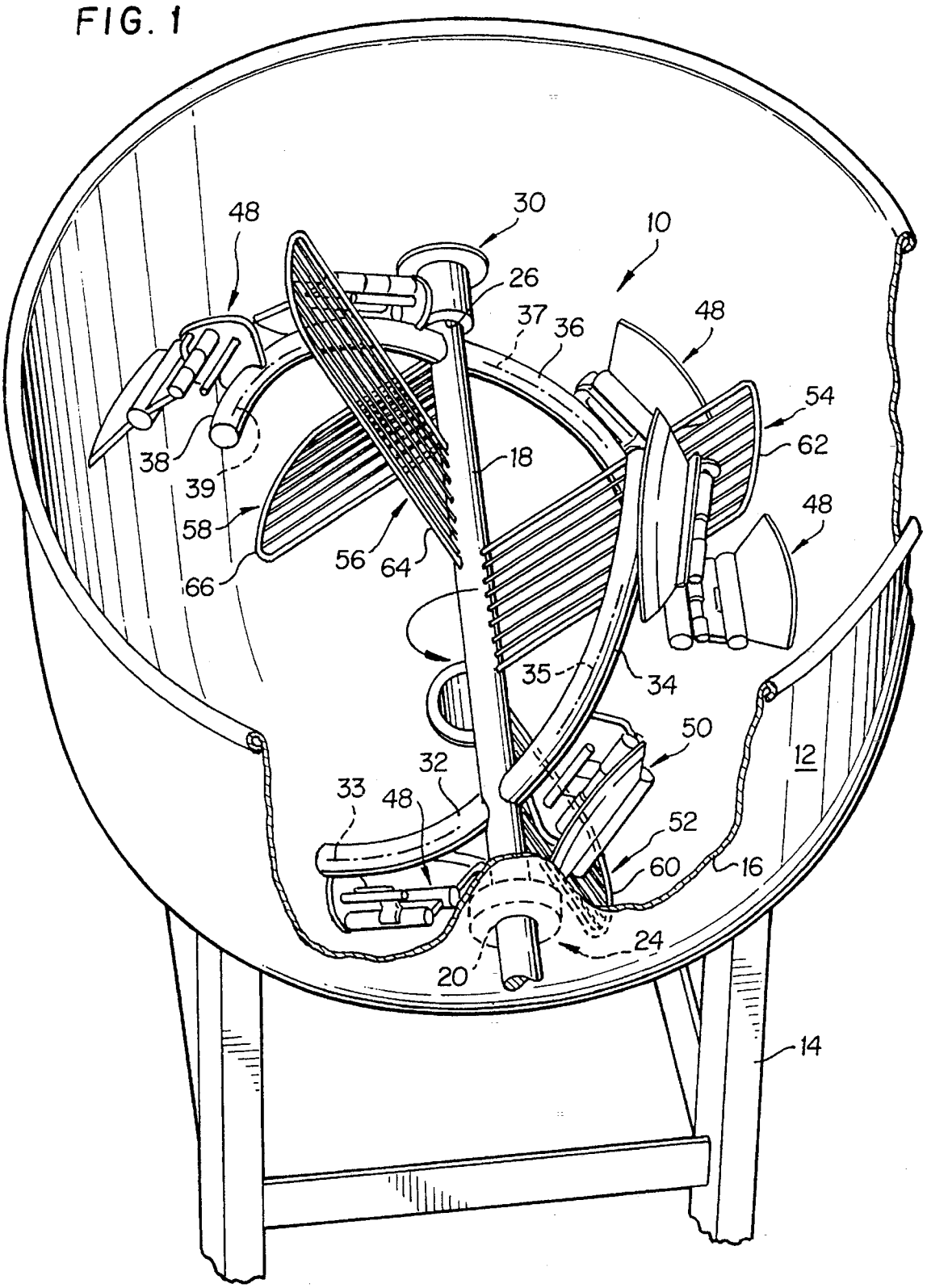
FIG. 1 is a perspective view partially cut away illustrating the mounting of one of the agitators of the invention within a kettle.

Referring now to the drawings and particularly to FIG. 1, a mixing agitator configured according to a preferred embodiment of the invention is shown to be disposed within a conventional kettle 12 for processing of food materials (not shown) such as potatoes which are to be held within the kettle 12. In the event that the agitator 10 is to be used to produce "lumpy" mashed potatoes as is a primary use of said agitator 10, it is to be understood that the potatoes can be cooked in a container other than the kettle 12 and then placed in the kettle 12 for processing by the agitator 10. Alternatively, the potatoes can be cooked within the kettle 12 prior to operation of the agitator 10. Cooking of the potatoes within the kettle 12 can also be accomplished during operation of the agitator 10.

The kettle 12 can be provided with a steam jacket (not shown) and supporting structure 14 of a conventional nature, the steam jacket not being shown for convenience of illustration. Reference is made to U.S. Pat. No. 4,790,667 for illustration of a conventional steam jacket as is conventional in the art. The kettle 12 could also be heated by means of conventional gas firing. The kettle 12 is seen to have a hemispherical bottom portion as is conventional in the art, inner walls 16 of the hemispherical portion constituting primary heating surfaces onto which food or other materials are brought into contact during a heating or cooking operation occurring within the kettle 12. As is described herein, the inner walls 16 of the kettle 12 can be scraped by portions of the agitator 10 to prevent sticking of food to the walls 16 due to localized overheating.

The agitator 10 is seen to comprise a rotary shaft 18 which is horizontally mounted within the kettle 12, one end of the shaft 18 being releasably carried by a bearing 20 while the other end of the shaft is formed as a split shaft 26 comprising a portion of a split shaft arrangement connected to bearings disposed externally of the kettle 12 as is described in U.S. Pat. No. 4,571,091. The structure and function of apparatus essentially identical to the bearing 20 and to the split shaft arrangement which includes the split shaft 26 is provided in U.S. Pat. No. 4,571,091 relative to the mounting within a kettle of an agitator having a horizontal shaft. The mounting structure thus described in U.S. Pat. No. 4,571,091 can be used to mount the present agitator 10 in the kettle 12 for rotary operation.

While not shown in the drawings for ease of illustration, the kettle 12 is preferably fitted with a lid so that the agitator 10 can be vigorously operated to reduce cooked potatoes held within the kettle 12 to mashed potatoes of a desired consistency.

In order to accomplish a mixing function of at least a partial nature, the shaft 18 is provided at end 24 with arcuate segments 32 and 34 which are circular in section and which are attached to the shaft 18 such as by welding. The central arcuate axes 33 and 35 of the arcuate segments 32 and 34 lie substantially in the same plane, that is, a plane taken through the longitudinal axis of the shaft 18 and centrally through the arcuate segments 32 and 34. For purposes of description, the arcuate segments 32 and 34 are thus said to lie in the same plane. The arcuate segments 32 and 34 essentially comprise segments of a circle having its center located along the longitudinal axis at or near the middle of the shaft 18, the circle having a radius extending to the central arcuate axes 33 and 35. Agitator segments 36 and 38 are seen to be mounted on the shaft 18 at locations near end 30, central arcuate axes 37 and 39 of said segments 36 and 38 having at least portions which lie in a plane which includes the longitudinal axis of the shaft 18. The plane in which the agitator segments 36 and 38 lie is preferably perpendicular to the plane in which the arcuate segments 32 and 34 lie. The particular structure and relationships of the arcuate segments 32, 34, 36 and 38 are described in detail in U.S. Pat. No. 4,790,667. The rotary shaft 18 and the segments 32, 34, 36 and 38 effectively provide a structure known as a "double anchor" structure with the "anchors" formed by the respective pairs of segments being preferably rotated 90° to each other.

Scraper assemblies 48 are mounted to the agitator 10 as is described in U.S. Pat. No. 4,790,667, six of the scraper assemblies 48 preferably being employed with a single scraper assembly 50 being utilized to scrape the inner walls 16 of the kettle 12. The mounting of the scraper assemblies 48, 50, as is best shown in U.S. Pat. No. 4,790,667, allows the scraping of the hemispherical portion of the kettle 12 with an overlap provided by each of the scraper assemblies 48, 50 to ensure full coverage of the inner walls 16. Detailed descriptions and illustrations of the scraper assemblies 48, 50 are provided in U.S. Pat. No. 4,790,667, structure also being described therein which allows continuous adjustability of scraping surfaces to facilitate contact with the inner walls 16 for accommodation of wear, to ensure adequate scraping, and to eliminate the need for periodic adjustment of the scraper assemblies 48, 50 to maintain positive contact between the assemblies 48, 50 and the inner walls 16 of the kettle 12.

It is to be understood that the mixing agitator 10 of the present invention preferably includes the scraper assemblies 48, 50 in any number of mounting arrangements capable of providing a desired scraping function. The mixing agitator 10 can also be employed without scraping capability in the event that scraping of inner walls of a kettle 12 is not required in a particular use environment. In the production of a desirable product consistency in institutional and commercial situations wherein a homemade, lumpy mashed potato product or similar product is desired, it is preferable for the mixing agitator 10 to be configured as is shown in FIG. 1. Kettles 12 of differing capacity can require scraping structure formed of differing numbers of scraping assemblies such as the assemblies 48, 50, the structure of such agitators clearly falling within the scope of the present invention. The mounting of the scraper assemblies 48, 50, as well as particular details of scraper elements are to be found in the disclosure of U.S. Pat. No. 4,790,667.

As can further be seen in FIG. 1, processing grates 52, 54, 56 and 58 are seen to be mounted to the rotary shaft 18 between the ends 24 and 30 of said shaft 18. In FIG. 1, each processing grate 52–58 is formed respectively of frame elements 60, 62, 64 and 66 which are substantially U-shaped with arm portions 68 thereof being joined at free ends thereof to the shaft 18 such as by welding. In each processing grate, interior bar elements 70 lie within the confines of each of the frame elements 60–66 and join at first ends thereof to the shaft 18 and at the other ends thereof to bight portion 72, the bar elements 70 being preferably joined to the shaft 18 and to the bight portion 72 of the respective frame elements 60–66 by welding or the like. It is to be noted that the two outermost processing grates 52 and 54 are essentially identical in structure but with respective bight portions 72 extending essentially upwardly from respective outermost arm portions 68 to respective innermost arm portions 68, thereby to generally follow the hemispherical structure of the inner walls 16 of the kettle 12. As will be seen in further embodiments of the invention, the bight portion 72 of the processing grates can be arcuate in order to more closely follow the contours of the inner walls 16 of the kettle 12. However, since the outermost portions of said processing grates 52–58 are not intended to touch the walls 16 of the kettle 12, it is not necessary for the conformations of the bight portion 72 to exactly follow the contours of the walls 16 of the kettle 12.

The two innermost processing grates 56 and 58 are seen to be diametrically opposed across the rotary shaft 18, that is, the grates 56 and 58 are disposed 180° from each other and effectively lie in a single plane. While the outermost processing grates 52 and 54 could potentially be disposed 180° apart in a similar fashion but turned 90° from the two innermost mixing paddles 56, 58, the particular space requirements of the kettle 12 and of other structural portions of the agitator 10 of FIG. 1 require that the processing grates 52 and 54 be out of plane with each other. However, the processing grate 52 can and preferably is located at a 90° offset to the innermost processing grates 56, 58.

Figure 2:
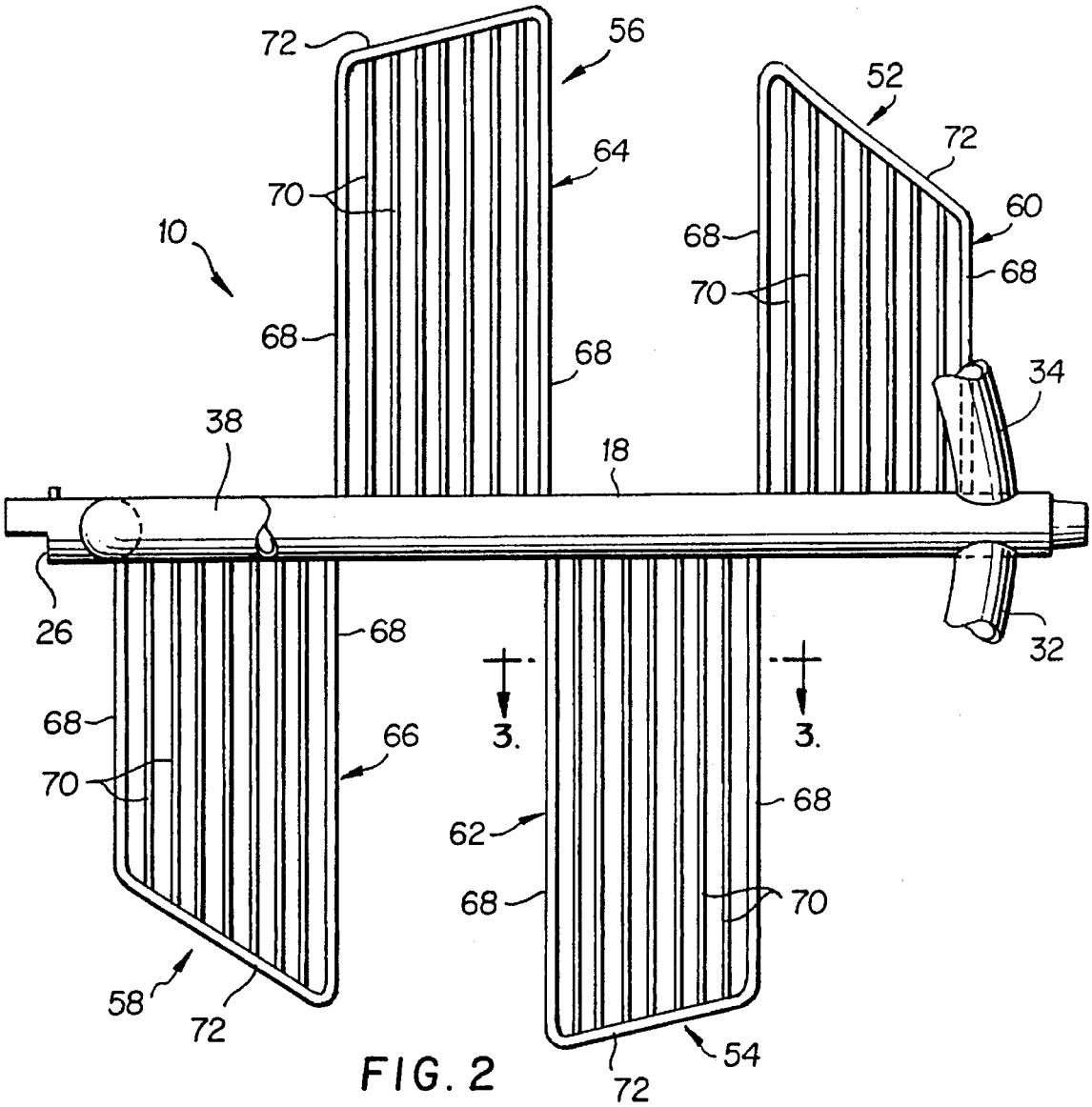
FIG. 2 is an elevational view of one of the present agitators and having processing grates of a particular configuration.
Figure 3:
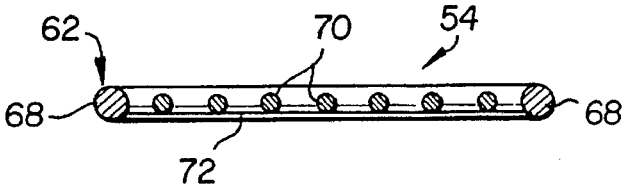
FIG. 3 is a sectional view taken along lines 3—3 of FIG. 2.

As is also seen in FIG. 2 and FIG. 3, the frame elements 60–66 and the interior bar elements 70 are formed of round bar stock, the round bar stock forming the frame elements 60–66 being preferably approximately ⅝" in diameter with the round bar stock forming the interior bar elements 70 being approximately ⅜" in diameter. The size of the bar stock forming said elements can vary by ⅛" either way and still produce a reasonably sized grate structure. The spacing between the interior bar elements 70 as well as the spacing between said elements 70 and the adjacent arm portions 68 of the frame assemblies 60–66 is approximately ½" with that spacing being capable of variation by ⅛" in acceptable embodiments of the invention. While these dimensions may otherwise vary, it is to be understood that the particular round or cylindrical shapes of the bar stock forming the frame elements 60–66 as well as the interior bar elements 70 act to produce "lump" sizes, lump shapes, a number of lumps and a lump distribution within a product such as mashed potatoes which is particularly acceptable.

As is seen in FIG. 1, the interior processing grates 56, 58 are formed with frame elements 64, 66 having bight portions 72 which are substantially perpendicular to the arm portions 68. As is seen in FIG. 2, the bight portions 72 can be angled for the interior processing grates 56, 58 in essentially the same manner as has been described relative to the outermost grates 52, 54. It is also to be noted in FIG. 2 that major portions of the segments 32, 34, 36 and 38 have been removed for ease of illustration of the processing grates 52–58. As will be understood by further reference to preferred embodiments of the invention, particular shapes of the frame elements can vary while retaining a capability of producing acceptable food products.

Figure 4:
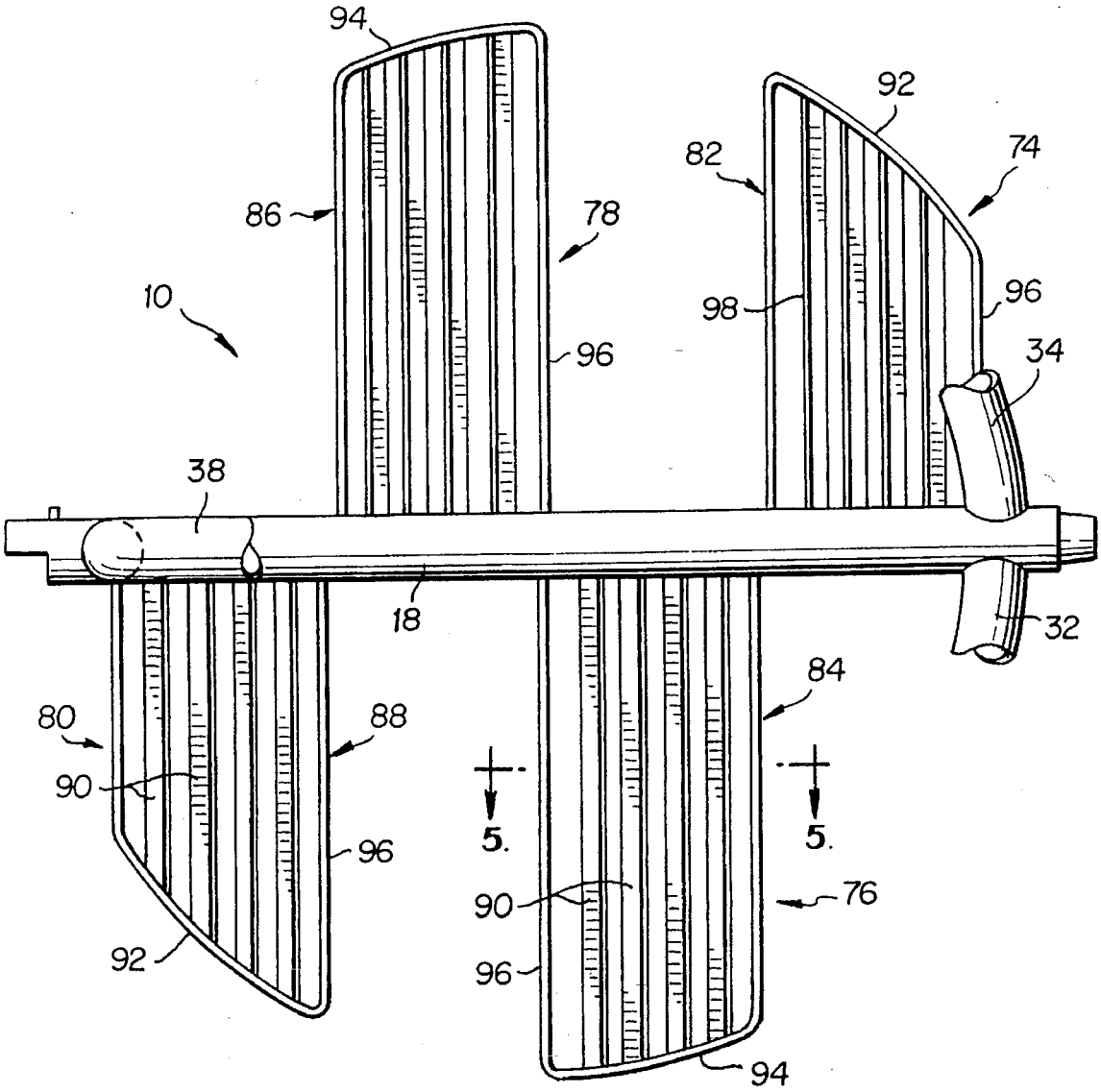
FIG. 4 is an elevational view of one of the present agitators having a particular processing grate configuration.
Figure 5:
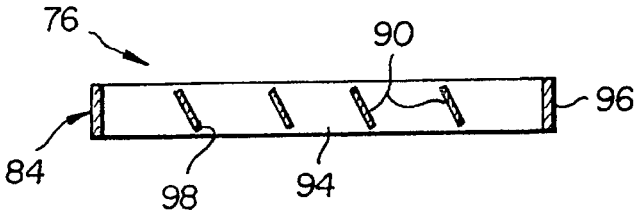
FIG. 5 is a sectional view taken along lines 5—5 of FIG. 4.

Referring now to FIGS. 4 and 5, processing grates 74, 76, 78, 80 are shown to be formed of frame elements 82, 84, 86 and 88 and interior bar elements 90 with the various mounting arrangements of these elements being substantially identical to that described relative to FIGS. 1 through 3. However, in FIGS. 4 and 5, the frame elements 82–88 and the interior bar elements 90 are formed of flat bar stock which is essentially rectangular in cross-section as best seen in FIG. 5. Bight portions 92 of the outermost frame elements 82, 84 are seen to be arcuate in shape as are the bight portions 94 of the innermost frame elements 86, 88, the respective shapes of the bight portions 92, 94 acting to sweep out a greater volume on rotation of the shaft 18 than occurs with the respective shapes of the bight portions 72 of FIG. 2 given similar length dimensions of respective arm portions of said grates. The relatively flat or rectangular solid conformations of the interior bar elements 90, as well as of the frame elements 82–88, act to produce an acceptable product such as lumpy mashed potatoes from actual cooked potatoes. Sharp edge portions such as edge portions 98 of the bar stock forming said frame elements 82–88 and the interior bar elements 90 act to cut through a food material such as a potato being mixed within the kettle 12 to produce "lumps" of a less rounded conformation than is produced by the round bar stock of the processing grates 52–58 described relative to FIG. 2 inter alia while still producing a product of acceptable organoleptic properties.

As are best seen in FIG. 5, the interior bar elements 90 of each of the processing grates 74–80 are angled. The angles of the interior bar elements 90 can vary on each of the grates 74–80. The sizes of the bar stock used to produce the grates 74–80 can be similar to the round bar stock described above with the spacings between elements being similar to those spacings described relative to the elements of FIG. 2 inter alia.

Figure 6:
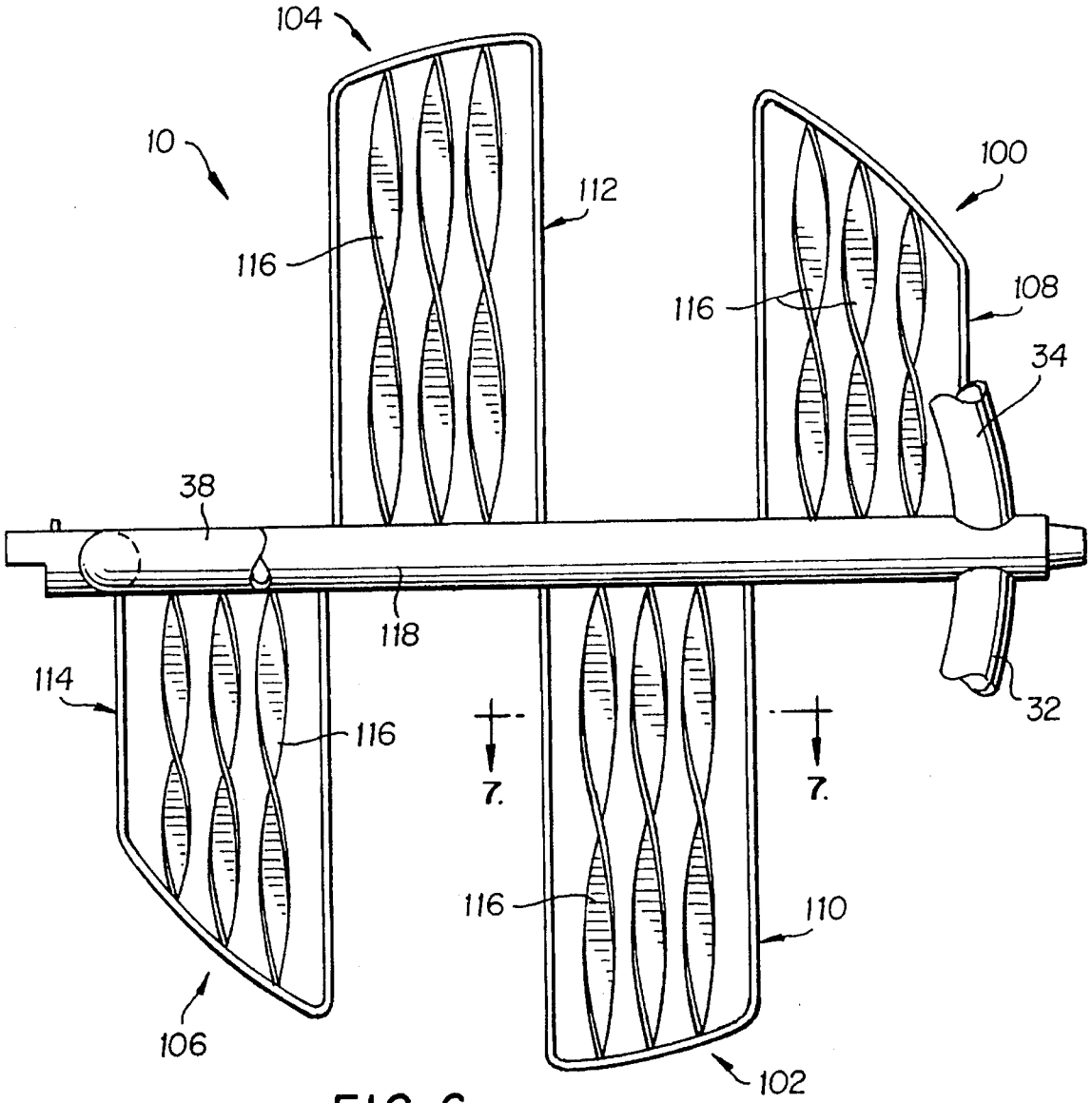
FIG. 6 is an elevational view of one of the agitators of the invention having a particular mixing paddle configuration.
Figure 7:
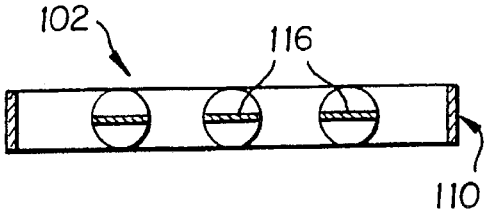
FIG. 7 is a sectional view taken along lines 7—7 of FIG. 6.

Referring now to FIGS. 6 and 7, processing grates 100, 102, 104 and 106 are formed respectively of frame elements 108, 110, 112 and 114, the frame elements being formed of flat bar stock or bar stock having a rectangular cross-section as described relative to FIGS. 4 and 5. Interior bar elements 116 are similarly formed of flat bar stock but are twisted one turn, that is, 360°, along the lengths thereof, the frame elements 108–114 and the twisted interior bar elements 116 being mounted to shaft 118 and to each other such as by welding and such as has been previously described. As is preferred according to the invention, the two innermost processing grates 104, 106 are located about the shaft 118 at a 180° spacing while the grate 100 is turned 90° to said innermost grates 104, 106, the other outermost processing grate 102 being also preferably turned 90° to the innermost grates 104, 106 and 180° relative to the grate 100. However, the processing grate 102 may be turned at other angles to the other processing grates 100, 104, 106 due to the need to locate other portions of the agitator in desirable locations so that scraping of walls 16 of the kettle 12 can occur.

Figure 8:
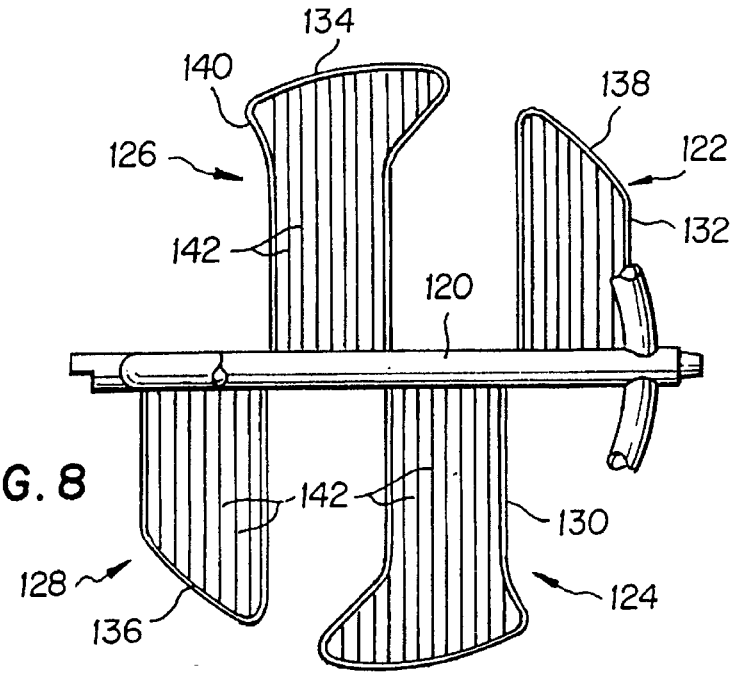
FIG. 8 is an elevational view of one of the mixing agitators of the invention; and, FIG. 9 is a perspective view of one of the mixing agitators of the invention.

Referring now to FIG. 8, a shaft 120 is seen to include four processing grates 122, 124, 126 and 128 with the innermost grates 126 and 128 having respective frame elements 130 and 132 with bight portions 134 and 136 respectively formed with an elevational shape similar to the cross-section of a shoe or the like such that certain portions of the bight portions 134, 136 overlap the swept out paths of others of the processing grates. The outermost processing grates 122, 124 are essentially formed in a fin shape with outermost arm portions and bight portions 138, 140 being respectively integrated into arcuate shapes. Interior bar elements 142 can be formed as desired of round or flat bar stock as can the frame elements of the processing grates 122–128. The embodiment of FIG. 8 essentially illustrates that the shapes of the processing grates of the invention can vary without departing from the scope of the invention.

Figure 9:
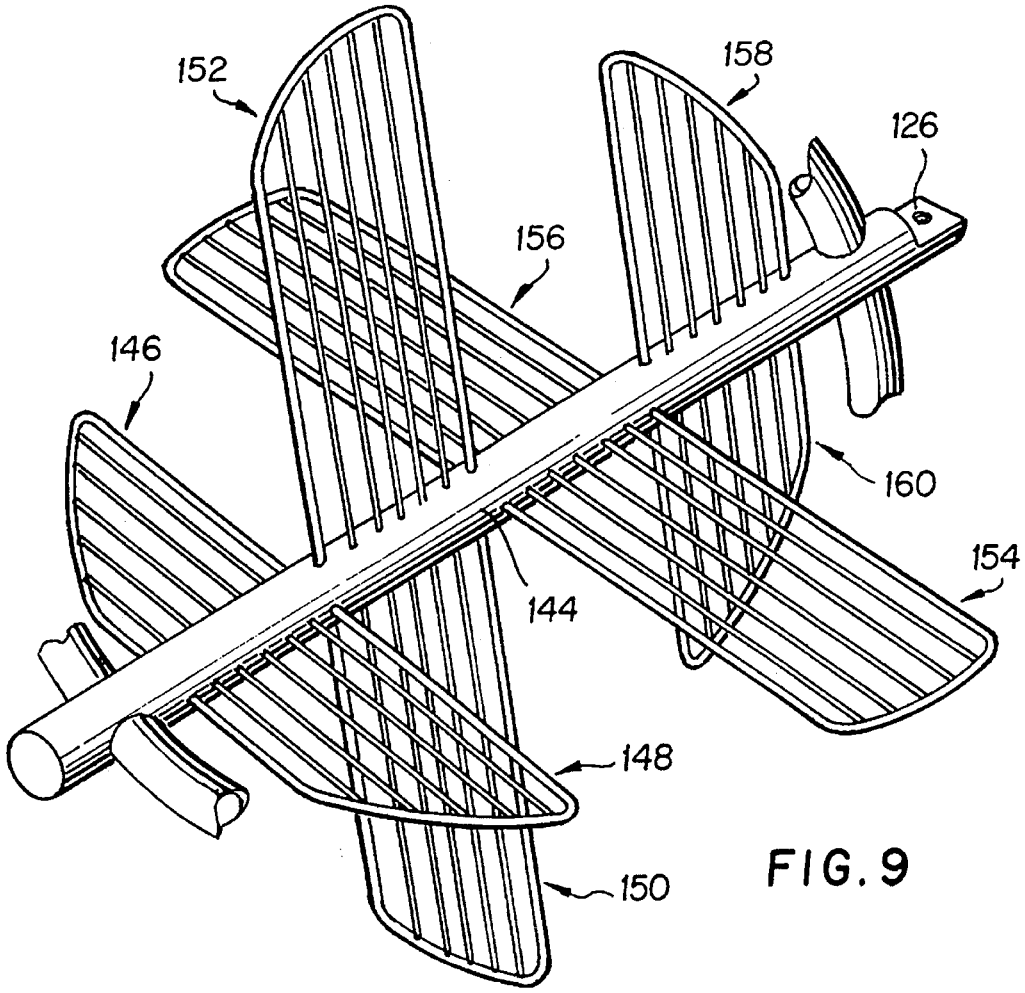

Referring now to FIG. 9, a shaft 144 forming a central part of a mixing agitator is seen with only processing grates 146, 148, 150, 152, 154, 156, 158 and 160 disposed on the shaft 144, other structure such as scraper assemblies, double anchor structural segments and the like not being shown for ease of illustration. The agitator of FIG. 9 includes eight of the processing grates with interior pairs thereof being disposed at an angle of 90° to each other with the processing grates of each pair of grates being disposed at an angle of 180° to each other. Outermost pairs of the processing grates are disposed at angles of 90° to each other with processing grates of the respective pairs being 180° in relation to each other. The processing grates 146–160 can be formed as are others of the processing grates described herein. The angular relationships between the processing grates 146–160 can also be varied without departing from the scope of the invention.

While the above-described structures have been explicitly described for ease of illustration, it is to be understood that the bar elements as well as the frame elements of the several processing grates can be formed of dissimilar bar stock within a particular processing grate. The bar stock can be dissimilar as to size and/or conformation inter alia with spacings between the bar elements and the frame elements also being capable of variation within a given processing grate. As one example, a frame element of a given grate can be formed of flat bar stock while one or more of the bar elements of the grate can be formed of round bar stock or other bar stock. The structures of the processing grates can also vary from grate to grate. In essence, the frame elements and the bar elements act to reduce through mechanical impaction a material such as potatoes to a desired consistency with "lumps" remaining in the overall body of the material being of a desired range of sizes, number and distribution within the relatively smooth or "creamy" body of the material. A quantity of the material of seven per cent remaining as "lumps" in the body of the material constitutes an acceptable product although variation is contemplated. The time of processing as well as the rate of revolution of an agitator such as the agitator 10 is also of note in processing of a material according to the invention. Processing times vary depending upon conditions such as the state of the food material when introduced into a kettle such as the kettle 12 for processing. The rate of revolution of an agitator such as the agitator 10 can vary, the rate of revolution being in a widely varying range but including 4 to 40 revolutions per minute being normally useful.

The function of the frame elements and bar elements include a certain degree of mixing function but are primarily intended to reduce the material being processed to the desired product consistency. The cross-sectional shape of the bar stock forming the frame elements and the bar elements is therefore of importance due to the different manner in which, for example, a bar having an edge will impact a material relative to the manner that a rounded bar will impact a material. A bar having an edge will act to "slice" a material while a rounded bar will create more rounded particles. Both functions can be employed in a given processing situation. Substantial mixing in the processing situations of the invention can occur by virtue of the rotation of that structure primarily intended for scraping of kettle walls, a further lifting, blending and mixing also occurring due to the action of said structure. In the event that additional mixing and blending is desired in a processing situation according to the invention, mixing paddles such as are described in U.S. Pat. No. 4,790,667 can be employed. However, it is desirable that a mixing paddle not be placed on an agitator shaft or otherwise disposed within the confines of a kettle such that the processing grates of the invention would be blocked or "screened" from reducing contact with the material being processed.

The present invention is also useful in the blending of food materials such as pie fillings such as lemon, chocolate and cream pie fillings as well as fruit fillings. As a general rule, the less dense the material to be blended, the close the spacings between bar elements and the smaller the diameter of the bar elements. For a pie filling such as lemon, for example, the bar elements can be formed of ⅛" diameter steel rod, i.e., 11 gauge wire, with a spacing between these 11 gauge rods being approximately ¼". The bar elements of any size can be staggered or arranged out of line as is referred to herein. Combinations of differently sized bar elements can be used together in the same processing grate and grates each having bar elements of a given size but different from each other can also be used.

The reducing bar elements as well as the frame elements of the present processing grates need not all be located in the same plane as is shown for convenience of illustration in the drawings. The bar elements can be out-of-plane randomly or can be oriented in configurations such as a V-shape as desired, such shapes potentially allowing more than one impact with a given piece of material during a single encounter between said piece of material and one of the processing grates. A given processing grate can also be angled in its attachment to a rotary shaft of an agitator as desired without departing from the scope of the invention.

It is also to be understood that the structure of the processing grates of the invention can be utilized with other horizontal and diagonally inclined agitator structures whether or not said structures include scraping capability. It is also to be understood that the agitators of the invention can have varying numbers of processing grates such as two or three or the like. In the case of an agitator structure having two processing grates, the processing grates are preferably disposed at an angle of 180° to each other. In the case of an agitator structure having three processing grates, the grates would preferably be arranged at angles of 120° to each other. It is also to be understood that the drawings generally show agitators employed with a kettle which is of a size to accommodate a volume of approximately 50 gallons, it being understood that the agitators of the invention can be configured for use in larger kettles. In such situations, a greater number of scraper assemblies and/or processing grates can be employed. In a similar sense, it is to be understood that the agitators of the invention can be configured other than as explicitly described herein yet remain within the intended scope of the invention. It will be apparent to those skilled in the art that given the above teachings, variations in structure are possible and that the scope of the invention is defined appropriately by the recitations of the appended claims.

What is claimed is:

1. An agitator mounted for rotation within a kettle within which food materials are processed to produce a food product of a desired consistency and having a substantially creamy texture with a desirable proportion of lumps formed of and in the food materials consistent with preparation of a homemade product such as mashed potatoes and the like, comprising:

a rotary shaft horizontally disposed within the kettle;

arcuate segments rigidly attached to and disposed two each on each end of the shaft, the arcuate segments at each end being disposed substantially in the same plane and being disposed diametrically opposite each other relative to the shaft, the planes within which the arcuate segments at each end of the shaft lie being fixed relative to each other during rotation;

means carried by the arcuate segments and extending toward inner walls of the kettle for contacting at least portions of the food materials within the kettle and displacing said materials within the kettle to effect mixing thereof; and, means carried by the agitator for reducing the particle sizes of at least a portion of the particles of the food materials to a desired range, number and distribution of particle sizes, thereby to produce a food product such as mashed potatoes having a creamy yet lumpy consistency indicative of homemade production of such food product.

2. The agitator of claim 1 wherein the planes within which the two pairs of arcuate segments lie are perpendicular to each other.

3. The agitator of claim 2 and further comprising means associated with the kettle for heating the food materials within the kettle and wherein the means carried by the arcuate segments comprise scraper elements which contact inner walls of the kettle to prevent adhesion of the materials to said inner walls.

4. The agitator of claim 3 and further comprising means carried by each arcuate segment for constantly adjusting the position of the scraper elements to accommodate surface irregularities in the inner walls of the kettle and to accommodate surface wear of the scraper elements to maintain the scraper elements in scraping relation to the inner walls of the kettle on rotation of the agitator.

5. The agitator of claim 4 wherein the scraper elements are mounted at spaced locations on the arcuate segments, the scraper elements being mounted in positions which cause overlap of the scraping paths of each of the respective scraper elements on motion within the kettle.

6. The agitator of claim 5 wherein each of the scraper elements are mounted at an angle relative to the plane containing the arcuate segment on which the scraper element is mounted.

7. The agitator of claim 4 wherein the arcuate segments at each end of the shaft lie in respective circles having a common center at the midpoint of the shaft and along the longitudinal axis thereof, radii from the center of one of the circles to the free ends of the segments at one end of the shaft making respective angles with the longitudinal axis of the shaft of 55° and 79°, and radii from the center of the other circle to the free ends of the segments at the other end of the shaft making respective angles with the longitudinal axis of the shaft of 103° and 80°.

8. The agitator of claim 1 wherein the reducing means comprise a plurality of elongated elements, at least two of which elongated elements are mounted to the shaft and extend therefrom in substantially the same direction in juxtaposition to each other and spaced from each other to allow passage of food materials therebetween.

9. The agitator of claim 8 wherein groupings of the elongated elements are mounted to the shaft along at least portions of the shaft, the elongated elements within said groupings being spaced apart from adjacent elongated elements.

10. The agitator of claim 9 and further comprising a frame element joining distal ends of the elongated element in each grouping.

11. The agitator of claim 9 wherein at least certain of the elongated elements are rod-like and are substantially rounded in cross-section.

12. The agitator of claim 11 wherein the elongated elements are substantially circular in cross-section with each element being approximately ⅜" in diameter and being spaced from adjacent elongated elements by approximately ½".

13. The agitator of claim 9 wherein at least certain of the elongated elements are rod-like and are substantially rectangular in cross-section.

14. The agitator of claim 9 wherein at least certain of the elongated elements are rod-like and are formed of flat bar stock twisted along longitudinal axes thereof over at least a portion of the lengths thereof.

15. The agitator of claim 9 wherein at least certain groupings of the elongated elements are located on the shaft diametrically across the shaft from certain other groupings of the elongated elements.

16. The agitator of claim 15 wherein at least certain of the diametrically disposed pairs of the groupings are rotationally spaced about the shaft at angles relative to certain other diametrically disposed pairs of the groupings.

17. The agitator of claim 16 wherein the pairs of the groupings are at 90° angles to each other.

18. In an agitator mounted for rotation within a kettle within which food materials are processed to include mixing of the food materials, the agitator having a rotary shaft, the improvement comprising:

means carried by the agitator for reducing the particle sizes of at least a portion of the food materials to a desired range, number and distribution of particle sizes, the reducing means comprising a plurality of elongated elements, at least two of which elongated elements are mounted to the shaft and extend therefrom in substantially the same direction in juxtaposition to each other and spaced from each other to allow passage of food materials therebetween, thereby to produce a food product such as mashed potatoes having a creamy, yet lumpy consistency indicative of homemade production of such food products.

19. In the improvement of claim 18 wherein groupings of the elongated elements are mounted to the shaft along at least portions of the shaft, the elongated elements within said groupings being spaced apart from adjacent elongated elements.

20. In the improvement of claim 19 and further comprising a frame element joining distal ends of the elongated elements in each grouping.

21. In the improvement of claim 19 wherein at least certain of the elongated elements are rod-like and are substantially rounded in cross-section.

22. In the improvement of claim 21 wherein the elongated elements are substantially circular in cross-section with each element being approximately ⅜" in diameter and being spaced from adjacent elongated elements by approximately ½".

23. In the improvement of claim 19 wherein at least certain of the elongated elements are rod-like and are substantially rectangular in cross-section.

24. In the improvement of claim 19 wherein at least certain of the elongated elements are rod-like and are formed of flat bar stock twisted along longitudinal axes thereof over at least a portion of the lengths thereof.

25. In the improvement of claim 19 wherein at least certain groupings of the elongated elements are located on the shaft diametrically across the shaft from certain other groupings of the elongated elements.

26. In the improvement of claim 25 wherein at least certain of the diametrically disposed pairs of the groupings are rotationally spaced about the shaft at angles relative to certain other diametrically disposed pairs of the groupings.

27. In the improvement of claim 26 wherein the pairs of the groupings are at 90° angles to each other.

28. In an agitator mounted for rotation within a kettle within which food materials are processed to include mixing of the food materials, the agitator having a rotary shaft, the improvement comprising:

means carried by the agitator for reducing the particle sizes of at least a portion of the particles of the food materials to a desired range, number and distribution of particle sizes, the reducing means comprising groupings of elongated elements mounted to the shaft along at least portions of the shaft, the elongated elements within said groupings being spaced apart from adjacent elongated elements, thereby to produce a food product such as mashed potatoes having a creamy yet lumpy consistency indicative of homemade production of such food product.

29. In the improvement of claim 28 and further comprising a frame element joining distal ends of the elongated elements in each grouping.

30. In the improvement of claim 28 wherein at least certain of the elongated elements are rod-like and are substantially rounded in cross-section.

31. In the improvement of claim 30 wherein the elongated elements are substantially circular in cross-section with each element being approximately ⅜" in diameter and being spaced from adjacent elongated elements by approximately ½".

32. In the improvement of claim 28 wherein at least certain of the elongated elements are rod-like and are substantially rectangular in cross-section.

33. In the improvement of claim 28 wherein at least certain of the elongated elements are rod-like and are formed of flat bar stock twisted along longitudinal axes thereof over at least a portion of the lengths thereof.

34. In the improvement of claim 28 wherein at least certain groupings of the elongated elements are located on the shaft diametrically across the shaft from certain other groupings of the longated elements.

35. In the improvement of claim 34 wherein at least certain of the diametrically opposed pairs of the groupings are rotationally spaced about the shaft at angles relative to certain other diametrically disposed pairs of the groupings.

36. In the improvement of claim 35 wherein the pairs of the groupings are at 90° angles to each other.

37. An agitator mounted for rotation within a kettle within which materials are processed to produce a product of a desired consistency, comprising:

a rotary shaft at least a portion of which extends into the interior of the kettle; and, means carried by the shaft for reducing particle size of at least a portion of the materials to a desired range, number and distribution of sizes, thereby to produce a product having a desired consistency.

38. The agitator of claim 37 wherein the reducing means comprise a plurality of elongated elements, at least two of which elongated elements are mounted to the shaft and extend therefrom in substantially the same direction in juxtaposition to each other and spaced from each other to allow passage of food materials therebetween.

39. The agitator of claim 38 wherein groupings of the elongated elements are mounted to the shaft along at least portions of the shaft, the elongated elements within said groupings being spaced apart from adjacent elongated elements.

40. The agitator of claim 39 and further comprising a frame element joining distal ends of the elongated elements in each grouping.

41. The agitator of claim 39 wherein at least certain of the elongated elements are rod-like and are substantially rounded in cross-section.

42. The agitator of claim 41 wherein the elongated elements are substantially circular in cross-section with each element being approximately ⅜" in diameter and being spaced from adjacent elongated elements by approximately ½".

43. The agitator of claim 39 wherein at least certain of the elongated elements are rod-like and are substantially rectangular in cross-section.

44. The agitator of claim 39 wherein at least certain of the elongated elements are rod-like and are formed of flat bar stock twisted along longitudinal axes thereof over at least a portion of the lengths thereof.

45. The agitator of claim 39 wherein at least certain groupings of the elongated elements are located on the shaft diametrically across the shaft from certain other groupings of the elongated elements.

46. The agitator of claim 45 wherein at least certain of the diametrically opposed pairs of the groupings are rotationally spaced about the shaft at angles relative to certain other diametrically disposed pairs of the groupings.

47. The agitator of claim 46 wherein the pairs of the groupings are at 90° angles to each other.

* * * * *